US011781792B2

(12) United States Patent
Lutz et al.

(10) Patent No.: US 11,781,792 B2
(45) Date of Patent: Oct. 10, 2023

(54) AIR-COOLED CHILLER WITH HEAT RECOVERY SYSTEM

(71) Applicant: Carrier Corporation, Palm Beach Gardens, FL (US)

(72) Inventors: Geoffrey Lutz, Montluel (FR); Alexis Guy, Montluel (FR)

(73) Assignee: CARRIER CORPORATION, Palm Beach Gardens, FL (US)

( * ) Notice: Subject to any disclaimer, the term of this patent is extended or adjusted under 35 U.S.C. 154(b) by 109 days.

(21) Appl. No.: 17/552,430

(22) Filed: Dec. 16, 2021

(65) Prior Publication Data

US 2022/0196301 A1 Jun. 23, 2022

(30) Foreign Application Priority Data

Dec. 18, 2020 (EP) ..... 20215623

(51) Int. Cl.
*F25B 41/20* (2021.01)
*F25B 13/00* (2006.01)

(52) U.S. Cl.
CPC ..... *F25B 41/20* (2021.01); *F25B 13/00* (2013.01)

(58) Field of Classification Search
CPC ..... F25B 41/20; F25B 13/00; F25B 49/027; F25B 2339/04; F25B 2339/047; F25B 2600/2507; F25B 2700/2106; F25B 2700/21163; F25B 6/04; F25B 2400/13; F25B 6/02; F25B 41/24; F25B 41/40; F25B 49/02; F25B 2400/19
See application file for complete search history.

(56) References Cited

U.S. PATENT DOCUMENTS 4,407,137 A * 10/1983 Hayes, Jr. ..... F25B 47/025 62/198
2020/0224894 A1* 7/2020 Mohite ..... F24F 3/1405
2020/0355381 A1 11/2020 Lutz

FOREIGN PATENT DOCUMENTS

CA 2172790 A1 * 9/1997
CN 2926937 Y * 7/2007
CN 204509753 U * 7/2015
CN 206488687 U * 9/2017
CN 206973946 U * 2/2018
CN 109915952 A 6/2019
(Continued)

OTHER PUBLICATIONS

European Search Report for Application No. 20215623.8; dated Jun. 8, 2021; 9 Pages.

*Primary Examiner* — Kun Kai Ma
(74) *Attorney, Agent, or Firm* — CANTOR COLBURN LLP

(57) ABSTRACT

An air-cooled chiller (100) includes a compressor (12); a cooler (14); a heat recovery heat exchanger (16), wherein the heat recovery heat exchanger is connected between an output of (12*b*) the compressor and an input header (20) of an air heat exchanger (60). A solenoid valve (30) is located in an input header (20) of the air heat exchanger to divide the input header into a first portion (20*a*) and a second portion (20*b*). A controller (32) is configured to control the solenoid valve (30). A second valve (34) is located in the output header (36) to divide the output header into a first portion (36*a*) and a second portion (36*b*). There is also provided a method of operating the air-cooled chiller and a method of retrofitting an existing serial-concept air cooled chiller, to provide the present air-cooled chiller.

14 Claims, 8 Drawing Sheets

(56) References Cited

FOREIGN PATENT DOCUMENTS

| | | | | |
|---|---|---|---|---|
| JP | S5618326 | A | | 2/1981 |
| JP | H02126052 | A | * | 5/1990 |
| JP | H0760038 | B2 | * | 6/1995 |
| JP | H09119723 | A | * | 5/1997 |
| JP | 2004353949 | A | * | 12/2004 |
| JP | 2012172919 | A | * | 9/2012 |
| KR | 101157498 | B1 | * | 6/2012 |
| KR | 101526821 | B1 | * | 6/2015 |
| KR | 20170126656 | A | * | 11/2017 |

* cited by examiner

AIR-COOLED CHILLER WITH HEAT RECOVERY SYSTEM

FOREIGN PRIORITY

This application claims priority to European Patent Application No. 20215623.8, filed Dec. 18, 2020, and all the benefits accruing therefrom under 35 U.S.C. § 119, the contents of which in its entirety are herein incorporated by reference.

TECHNICAL FIELD

The present disclosure relates to an air-cooled chiller, a method of controlling an air-cooled chiller, and a method of retrofitting an air-cooled chiller.

BACKGROUND

There are two main concepts for recovering heat in an air-cooled chiller using a heat-recovery heat exchanger. These are the so-called "parallel concept" and "serial concept". The parallel concept is the most commonly used concept, and the idea is to arrange the heat recovery heat exchanger in parallel with air-cooled coils of the condenser. This concept has the advantage of relatively good performance under all environmental conditions (i.e. all air temperatures of the air flowing past the coils). However, it has the disadvantage of being relatively expensive and being complex to implement. In the serial concept, the idea is to set the heat-recovery heat exchanger in series with the coils of the condenser. This concept has the advantages of being cheap and easy to use and implement. However, this concept has the disadvantage that performance is strongly impacted by outside air temperature, i.e. the air temperature flowing over the coils that exchange heat between the refrigerant and the outside air.

It is desirable to provide an improved air-cooled chiller to mitigate the aforesaid disadvantages.

SUMMARY

According to a first aspect, the disclosure provides an air-cooled chiller comprising: a compressor; a cooler; a heat recovery heat exchanger, wherein the heat recovery heat exchanger is connected between an output of the compressor and an input header of an air heat exchanger; the air heat exchanger comprising: a first coil and a second coil; wherein the input header is connected to respective inlets of the first and second coils; wherein an output header is connected to respective outlets of the first and second coils; a solenoid valve located in the input header to divide the input header into a first portion and a second portion, wherein the first coil inlet is connected to the first portion and the second coil inlet is connected to the second portion, wherein the solenoid valve selectively controls refrigerant flow into the second portion, such that when the solenoid valve is open, refrigerant is allowed to flow through both the first and second coils in parallel and, when the solenoid valve is closed, refrigerant is prevented from flowing into the second coil; a controller configured to control the solenoid valve; and a second valve located in the output header to divide the output header into a first portion and a second portion, wherein the first coil outlet is connected to the first portion and the second coil outlet is connected to the second portion, and wherein the second valve is configured to prevent refrigerant flow from the first portion into the second portion of the outlet header; wherein the first portion of the input header is configured to receive fluid from the compressor output, via the heat recovery heat exchanger; and the first portion of the outlet header is connected to one or more lines for returning fluid to the compressor.

The solenoid valve therefore acts to allow refrigerant flow through the second coil when the solenoid valve is open. When the solenoid valve is closed, refrigerant only flows through the one or more coils connected to the first portion of the inlet header. As such, the solenoid valve controls how much of the air heat exchanger is in use for heat exchange between the air and refrigerant at any given time. Reducing the capacity of the air heat exchanger (by closing the solenoid valve) reduces the amount of cooling experienced by the refrigerant flowing through the air heat exchanger. The refrigerant leaving the outlet header therefore contains more heat than if the solenoid valve was open, and as a result of the extra heat, the chiller has increased heating capacity when the solenoid valve is closed. The solenoid valve in the inlet header may be closed when the outside air temperature is relatively low, and this may significantly improve the heating capacity compared to a prior art serial concept chiller (i.e. one lacking solenoid valve(s) in the inlet header).

The chiller may comprise a refrigerant recovery line connecting the output header to the cooler, the refrigerant recovery line having a recovery solenoid valve to selectively allow refrigerant to flow from the output header to the cooler.

When the solenoid valve in the inlet header is closed, the recovery solenoid valve may be opened to allow refrigerant to flow from the (currently unused) coils to the cooler. This can help to ensure sufficient refrigerant charge throughout the active parts of the chiller cooling circuit while at least one of the coils of the air heat exchanger is currently unused.

The second valve, in the outlet header, may be a check valve or a solenoid valve. A solenoid valve may have the advantage of allowing finer control of fluid flow in the second portion. Using solenoid valve(s) as the second valve(s) may be particularly desirable in embodiments where the outlet header is divided into more than two portions. A check valve may provide a simple and reliable option for preventing fluid flow from the first portion into the second portion of the outlet header.

The chiller may comprise an economising heat exchanger connected between the output header and the compressor. The economizer heat exchanger may selectively allow fluid flow to an economizer port of the compressor, and this can allow further control of the chiller's heating and cooling capacity. One or more expansion valves associated with the economizer heat exchanger may be used to control the flow to the economizer port.

A plurality of coils may be connected, in parallel with one another, between the first portion of the inlet header and the first portion of the outlet header. Alternatively or additionally, a plurality of coils may be connected, in parallel with one another, between the second portion of the inlet header and the second portion of the outlet header.

Having more coils connected to a given portion can increase the cooling capacity of that portion and, correspondingly, increase the change in overall heating/cooling capacity of the chiller when the second portion is closed off by the solenoid valve.

The cooler may be arranged to exchange heat with a fluid flow flowing through the cooler, to cool the fluid flow.

The fluid flowing through the cooler may be water. The chiller may thereby allow for the provision of a flow of cooled water.

The heat recovery heat exchanger may be arranged to exchange heat with a fluid flow flowing past the heat recovery heat exchanger, to heat the fluid flow.

The fluid flow may be a flow of water. The chiller may thereby allow for the provision of a flow of heated water. This may be in addition to, or alternatively to, the provision of a flow of cooled fluid (water).

In combination, the chiller may allow for the provision of both a heated water flow and a separate cooled water flow.

The controller may comprises or be connected to a temperature sensor configured to sense a temperature of the fluid flow at an outlet of the heat recovery heat exchanger. The controller may then be configured to close the solenoid valve in the inlet header when the temperature of the fluid flow at the outlet of the heat recovery heat exchanger is below a predetermined threshold.

In a prior art system that cannot selectively alter the number of coils being used in the air heat exchanger, when the (hot water) fluid flow is not sufficiently hot, the prior art system must either increase the speed of the compressor or reduce the air flow passing over the air heat exchanger coils (e.g. by reducing a fan speed), in order to sufficiently heat the other fluid flow. In the present system, controlling the number of coils in-use in the air heat exchanger, by control of the solenoid valve in the inlet header, allows for the provision of a sufficiently hot fluid flow out of the heat recovery heat-exchanger when the compressor is already at maximum capacity and the fan is stopped.

The air-cooled chiller may comprise a third coil; a second solenoid valve in the inlet header, such that the inlet header is divided by the solenoid valves into first, second and third portions; and a second second valve in the outlet header such that the outlet header is divided by the two second valves into first, second and third portions; wherein the third coil is connected between the third portion of the inlet header and the third portion of the outlet header.

The provision of extra portions in the inlet and outlet headers may allow finer control of the heating/cooling capacity of the chiller. Thus, at some times, all coils may be used. At other times, the third portion (only) may be closed off, by closing the second solenoid valve. At other times, both the second and third portions may be closed off, by closing at least the first solenoid valve. In the general case, there may be provided an air heat exchanger having n-coils and having (n−1) solenoid valves provided in the inlet header to divide the inlet header into n-portions, such that each portion connects to a single coil. Correspondingly, there would be (n−1) second valves in the outlet header to divide the outlet header into n-portions such that each portion connects to a single coil. This means that any number of the coils of the air heat exchanger may be used or not used as desired at any given time.

According to another aspect, there is provided a two-circuit air-cooled chiller comprising a first circuit that comprises an air-cooled chiller of the first aspect; and a second circuit that comprises an air-cooled chiller of the first aspect. The two-circuit air-cooled chiller may be configured such that the or each solenoid valve in the inlet header of the first circuit is controllable independently of the or each solenoid valve in the inlet header of the second circuit.

The two circuits may therefore be controlled separately to provide finer control of the overall heating/cooling provided by the two-circuit chiller.

The heat recovery heat exchangers of the two circuits may both be arranged to provide heat to the same fluid flow, i.e. both may be used in the production of a single hot water flow. Alternatively or additionally, the coolers of the two circuits may both arranged to provide cooling to the same fluid flow, i.e. both may be used in the production of a single cold water flow.

According to another aspect, there is provided a method of operating the air-cooled chiller according to any of the above aspects. The method may comprise: flowing a refrigerant through the air heat exchanger; detecting a fluid temperature of a fluid flow flowing out of the heat recovery heat exchanger; and when the temperature of the fluid flowing out of the heat recovery heat exchanger is below a predetermined threshold, using the controller to close at least one solenoid valve in the inlet header to prevent refrigerant flow through at least one of the coils.

The method allows the heating/cooling capacity of the chiller to be finely controlled, without needing to increase power to the compressor or restrict the cooling provided the by cooler.

The method may comprise the step of, when at least one solenoid valve is closed, flowing refrigerant from at least one coil through which refrigerant flow is prevented, to the cooler.

This may allow refrigerant recovery when some of the coils are closed off. This can ensure sufficient refrigerant is available throughout the currently-operating parts of the cooling circuit when some of the coils are not currently in-use.

According to another aspect, there is provided a method of retrofitting a serial concept air-cooled chiller to provide the air cooled chiller according to the first two aspects, wherein the serial concept air-cooled chiller comprises an inlet header, an outlet header, and at least first and second coils connected between the inlet header and outlet header. The method may comprising: installing a solenoid valve in the inlet header at a location between an inlet of the first coil and an inlet of the second coil, such that the solenoid valve may selectively control refrigerant flow to the inlet of the second coil; installing a second valve in the outlet header at a location between an outlet of the first coil and an outlet of the second coil; and connecting a controller to the solenoid valve to control the solenoid valve.

This may allow an existing air cooled chiller to be improved without making a whole new chiller (and discarding the old one). This may allow more cost-effective provision of the inventive chiller.

The method may further comprise, installing a refrigerant recovery line to connect between the outlet of the second coil and the cooler, the refrigerant recovery line having a recovery solenoid valve.

Adding a refrigerant recovery line can provide the advantage of ensuring sufficient refrigerant charge throughout the parts of the system that are in-use while some of the coils of the retrofitted chiller are not in-use.

BRIEF DESCRIPTION OF THE DRAWINGS

Certain embodiments of the present disclosure will now be described in greater detail by way of example only and with reference to the accompanying drawings in which.

DETAILED DESCRIPTION OF THE INVENTION

Figure 1B:
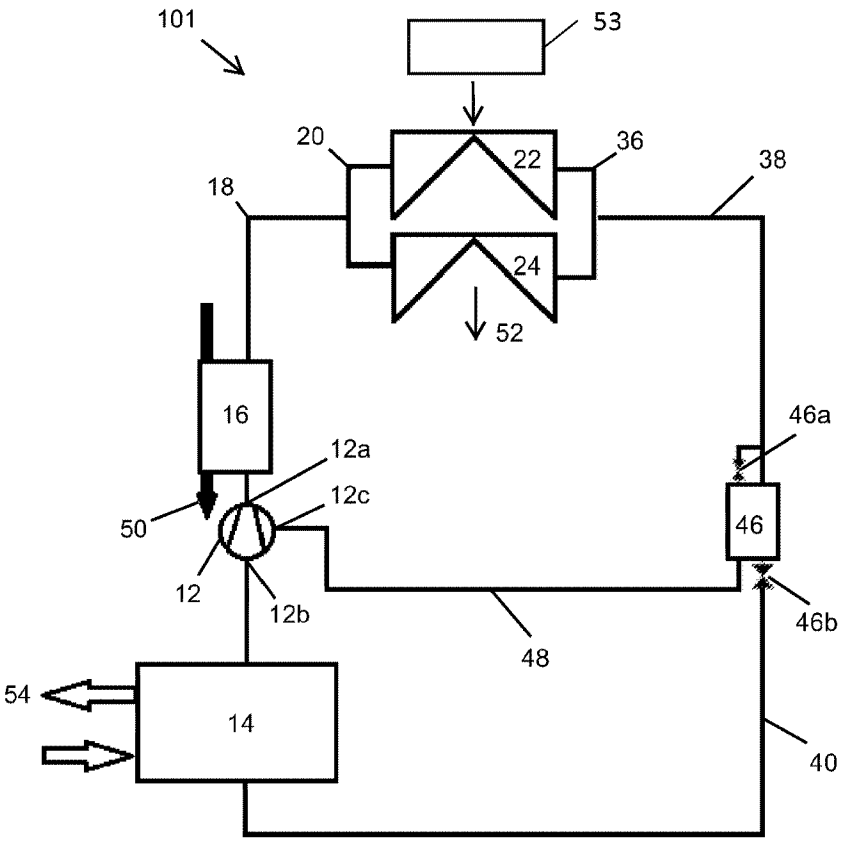
FIGS. 1A and 1B show prior art "serial concept" air cooled chillers.
Figure 1A:
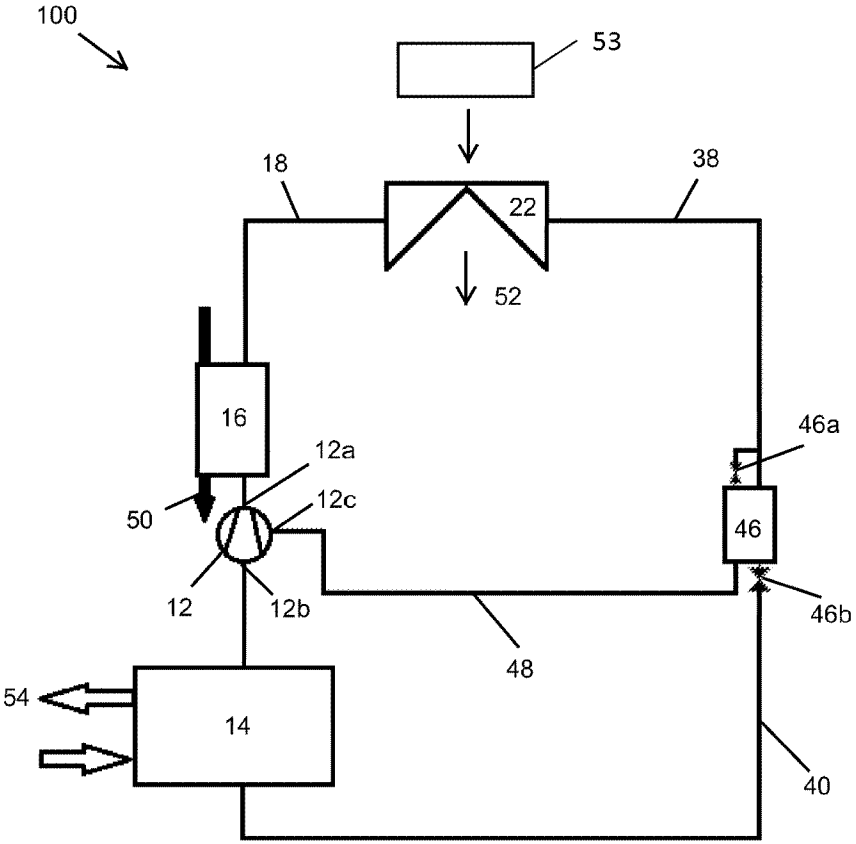

FIG. 1A shows a known arrangement of an air-cooled chiller of the "serial concept". The air-cooled chiller 100 comprises a compressor 12, a cooler 14, a heat-recovery heat exchanger 16, a coil 22, and an economizer heat exchanger 46. In operation, compressed refrigerant flows out from a compressor outlet 12*a* of the compressor 12 and into the heat-recovery heat exchanger 16. In the heat-recovery heat exchanger 16, heat is exchanged between the compressed refrigerant from the compressor 12 and a fluid flow 50 through the heat-recovery heat exchanger 16. This produces a heated fluid flow 50. The refrigerant then flows on from the heat-recovery heat exchanger 16, along a line 18, to the coil 22.

In the coil 22, heat is exchanged between the refrigerant and an airflow 52. The refrigerant then flows from the coil 22, along a line 38, to an economizer heat exchanger 46.

A fan 53 may be used to drive the airflow 52 past the coil 22.

A pair of controllable expansion valves 46*a*,46*b* are associated with the economizer heat exchanger 46. The controllable expansion valves 46*a*,46*b* may be varied incrementally between fully-closed and fully-open states. The controllable expansion valves 46*a*,46*b* may be controlled independently of one another. The expansion valves 46*a*,46*b* are to reduce the pressure between the condensing pressure and the evaporating pressure.

If a first of the expansion valves 46*a* is open, refrigerant coming from the coil 22 flows through a first portion of the economizer heat exchanger 46 and then along an economizer line 48 to an economizer inlet 12*c* of the compressor 12. If the first solenoid valve 46*a* is closed, refrigerant does not flow through the first portion of the economizer heat exchanger 46.

A second 46*b* of the expansion valves is kept at least partially open during operation of the air-cooled chiller 100. As this valve 46*b* is at least partially open, refrigerant coming from the coil 22 flows through a second portion of the economizer heat exchanger 46 and then flows along a line 40 to the cooler 14. The amount by which the second expansion valve 46*b* is kept open may be determined based on the load of the chiller (e.g. compressor speed) and on any sensed conditions (e.g. temperature of the fluid flow 50 at the outlet of the heat-recovery heat exchanger 16 or temperature of a fluid flow 54 at an outlet of the cooler 14).

In the cooler 14, heat is exchanged between the refrigerant and a fluid flow 54, such as a water flow. This may produce a cooled fluid flow 54 flowing out of the cooler 14. The refrigerant then passes from the cooler 14 to a main inlet 12*b* of the compressor 12.

FIG. 1B shows another known prior art air-cooled chiller 101 that is identical to the air-cooled chiller 100 of FIG. 1A except that, instead of a single coil 22, the air cooled chiller 101 has an air heat exchanger comprising an inlet header 20 and an outlet header 36, and two coils 22,24 connected between the headers 20,36. In operation, refrigerant flows from line 18 into the inlet header 20, through both coils 22,24 in parallel, and into the outlet header 36 and into line 38. Both coils 22,24 exchange heat with the airflow 52. Other than this, operation is identical to the air-cooled chiller 100 of FIG. 1A.

Figure 2:
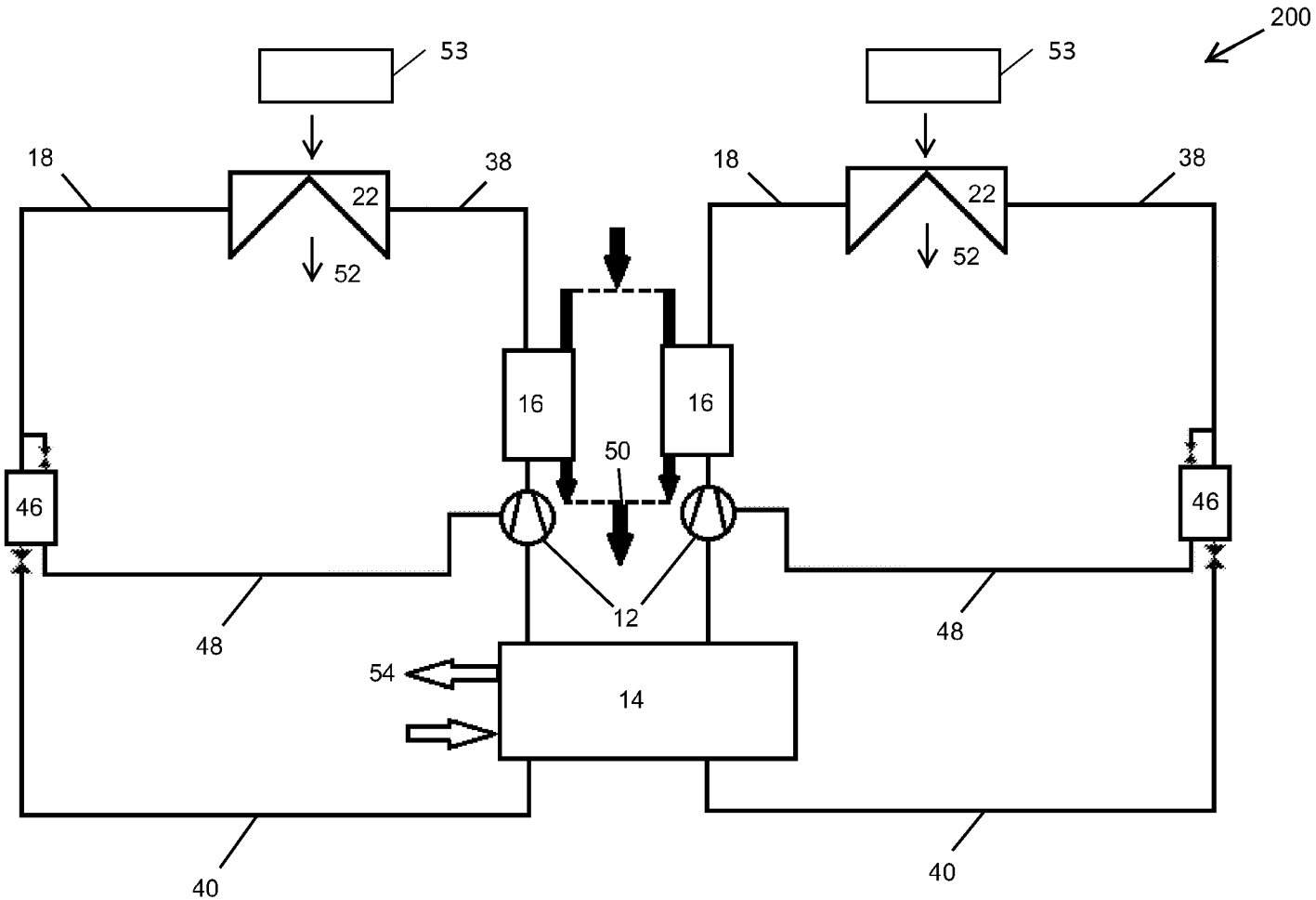
FIG. 2 shows another prior art air-cooled chiller.

FIG. 2 shows a known prior art air-cooled chiller 200 having two refrigerant circuits. The refrigerant circuits each have the same components as the (single-circuit) air-cooled chiller 100 shown in FIG. 1. Both fluid circuits' heat recovery heat exchangers 16 exchange heat with the fluid flow 50, and both circuits connect to the same cooler 14 to exchange heat with the fluid flow 54.

It is known that the Outside Air Temperature (OAT), i.e. a temperature of the airflow 52 over the coil 22, has a strong impact on the heat transfer efficiency of "serial concept" air-cooled chillers 100,200.

Figure 3:
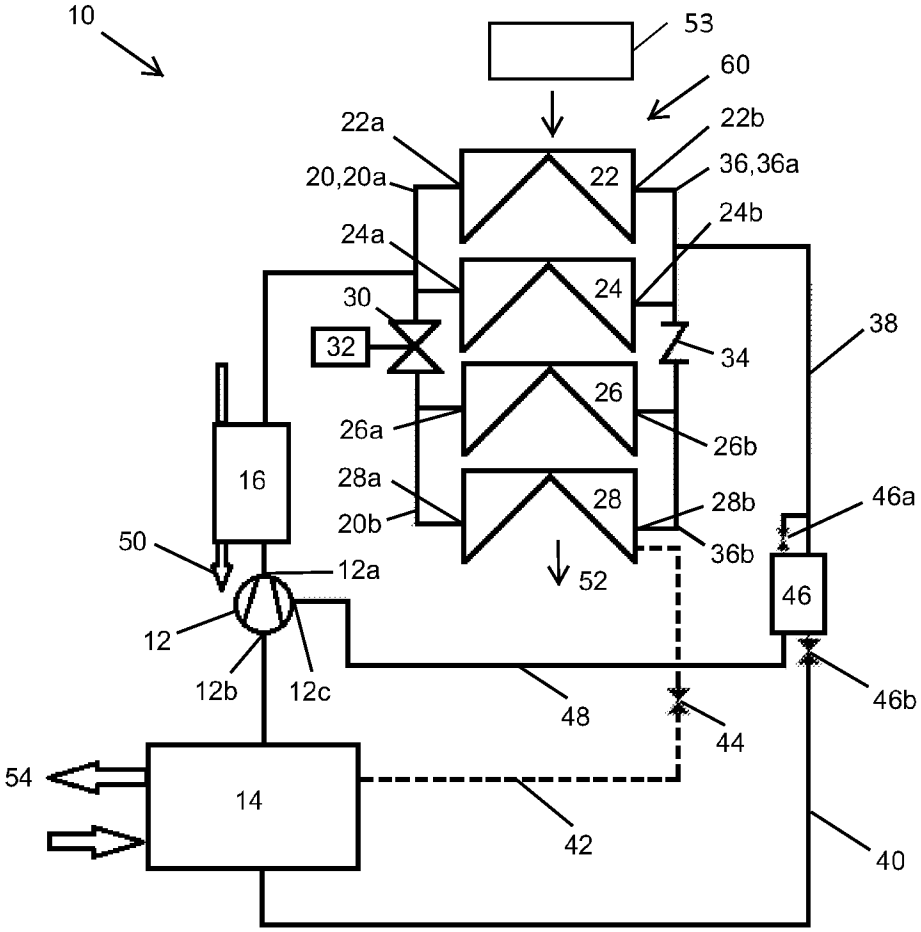
FIG. 3 shows an air-cooled chiller according to the present disclosure.

FIG. 3 shows an air-cooled chiller 10 according to the present disclosure. Several components of the present air-cooled chiller 10 are the same as in the prior art air-cooled chiller 100,101, e.g. as shown in FIGS. 1A and 1B, and so like components will use like reference numerals.

The present air-cooled chiller 10 shown in FIG. 3 comprises a compressor 12, a cooler 14, a heat-recovery heat exchanger 16, a line 18 connecting the heat recovery heat exchanger 16 to an inlet header 20, a plurality of coils 22,24,26,28, and an outlet header 36. Each of the coils 22,24,26,28 has a coil inlet 22*a*,24*a*,26*a*,28*a* connected to the inlet header 20. Each of the coils 22,24,26,28 has a coil outlet 22*b*,24*b*,26*b*,28*b* connected to the outlet header 36.

The inlet header 20, outlet header 36 along with all coils 22-28 and other equipment therebetween (e.g. valves 30,34 etc.) together define the air heat exchanger 60.

A fan 53 may be used to drive the airflow 52 past the coils 22-28 of the air heat exchanger 60.

In operation, refrigerant flows out of a compressor outlet 12*a* of the compressor 12 and into the heat-recovery heat exchanger 16. In the heat-recovery heat exchanger 16, heat is exchanged between a fluid flow 50 through the heat-recovery heat exchanger 16 and the refrigerant from the compressor 12. This produces a heated fluid flow 50. Heated fluid flow may be, for example, hot water. In one non-limiting example, the heated fluid flow may be hot water output at a temperature of 45° C. The refrigerant from the compressor 12 then flows on from the heat-recovery heat exchanger 16, along line 18, to the inlet header 20 of the air heat exchanger 60.

A solenoid valve 30 is connected to the inlet header 20 to selectively control refrigerant flow within the inlet header 20. Specifically, the line 18 connects to a first portion 20*a* of the inlet header that connects to an inlet of at least one of the coils. In the example shown in FIG. 3, the first portion 20*a* connects to the inlets 22*a*,24*a* of the first two coils 22,24. However, in other examples, further coils may connect to the first portion 20*a*. The solenoid valve 30 is controlled by a controller 32.

The solenoid valve 30 selectively allows refrigerant flow into a second portion 20*b* of the inlet header 20, wherein the second portion connects to at least one of the coils. In the example shown in FIG. 3, the second portion 20*b* connects to the second two coils 26,28. However, other numbers of coils may connect to the second portion 20*b*.

A second valve 34 is located in a position in the outlet header 36 that corresponds to the solenoid valve's 30 position in the inlet header 20. That is, the outlet header 36 is divided, by the second valve 34, into a first portion 36*a* and second portion 36*b*. The first portion 36*a* of the outlet header 36 connects to the same coils 22,24 as are connected to the first portion 20*a* of the inlet header. The second portion 36*b* of the outlet header connects to the same coils 26,28 as are connected to the second portion 20*b* of the outlet header.

As described in more detail below, the purpose of the second valve 34 is to prevent refrigerant from flowing from the first portion 36*a* into the second portion 36*b* of the outlet header.

The second valve 34 may be a check valve or may be a solenoid valve. In examples where the second valve is a solenoid valve, the second valve 34 is controlled (e.g. by the same controller 32 as for the solenoid valve 30), or by its own dedicated controller, to be open when the (first) solenoid valve 30 is open and kept closed when the (first) solenoid valve 30 is closed.

A refrigerant recovery line 42 is connected to either the second portion 36*b* of the outlet header or (as shown in FIG. 3) connected directly to an outlet 28*b* of one of the coils 26,28 that connects to the second portion 36*b* of the outlet header 36. A recovery solenoid valve 44 is located on the refrigerant recovery line 42. The refrigerant recovery line 42 connects to the cooler 14. A check valve may be used in addition to the recovery solenoid valve 44, to ensure proper control of refrigerant through the recovery line 42. In other examples, there may be further recovery lines that connect one of the coils to the cooler 14, each recovery line also having a recovery solenoid valve 44 (and, optionally, a check valve).

The first portion 36*a* of the outlet header 36 is connected to a line 38 that connects to the economizer heat exchanger 46.

A pair of controllable expansion valves 46*a*,46*b* are associated with the economizer heat exchanger 46. The controllable expansion valves 46*a*,46*b* may be varied incrementally between fully-closed and fully-open states. The controllable expansion valves 46*a*,46*b* may be controlled independently of one another. The expansion valves 46*a*,46*b* are to reduce the pressure between the condensing pressure and the evaporating pressure.

If a first of the expansion valves 46*a* is open, refrigerant coming along the line 38 from the outlet header 36 flows through a first portion of the economizer heat exchanger 46 and then along an economizer line 48 to an economizer inlet 12*c* of the compressor 12. If the first solenoid valve 46*a* is closed, refrigerant does not flow through the first portion of the economizer heat exchanger 46.

If a second of the expansion valves is open, refrigerant coming from the outlet header 36 flows through a second portion of the economizer heat exchanger 46 and then flows to the cooler 14. During operation of the chiller, the second expansion valve 46*b* is kept at least partially open so that at least some refrigerant flows along line 40 to the cooler 14. The degree to which the second expansion valve 46*b* is kept open during operation depends on the load of the chiller (e.g. compressor speed) and on any sensed conditions (e.g. temperature of the fluid flow 50 at the outlet of the heat-recovery heat exchanger 16 or temperature of a fluid flow 54 at an outlet of the cooler 14).

During operation, refrigerant from the compressor 12 flows through the heat exchanger 16 to provide heat to the fluid flow 50. Thereafter, the refrigerant flows along line 18 and enters the inlet header 20 and flows through at least the coils 22,24 connected to the first portion 20*a* of the inlet header to the first portion 36*a* of the outlet header 36. Refrigerant flows out of the outlet header 36 and into the line 38 towards the economizer heat exchanger 46.

If the solenoid valve 30 is open, the refrigerant also flows through the coils 26,28 connected to the second portion 20*b* of the inlet header 20. The refrigerant flows through these coils 26,28 and into the second portion 36*b* of the outlet header 36. The refrigerant then flows through the second valve 34, into the first portion 36*a* of the outlet header 36, and then into the line 38 towards the economizer heat exchanger 46.

If the solenoid valve 34 is closed, the refrigerant does not flow through into the second portion 20*b* of the inlet header 20. The second valve 34 ensures that refrigerant flowing out of the outlets 22*b*,24*b* of the coils 22,24 connected to the first portion 36*a* of the outlet header 36 does not flow into the second portion 36*b* of the outlet header 36.

The coils 22,24,26,28 allow heat to be exchanged between the refrigerant from the inlet header 20 with an air flow 52 flowing past the coils 22,24,26,28. A fan 53 may be used to drive air past the coils 22,24,26,28.

In the cooler 14, heat is exchanged between a fluid flow 54 through the cooler 14 and the refrigerant from the line 40. This produces a cooled fluid flow 54. The cooled fluid flow may be a flow of cooled water. In one non-limiting example, the cooled fluid flow is water output at a temperature of 7° C. The refrigerant exits the cooler 14 and flows to a main inlet 12*b* of the compressor 12.

During operation, when the solenoid valve 30 is open, the recovery solenoid valve 44 is kept closed. When the solenoid valve 30 is closed, the recovery solenoid valve 44 may be selectively opened to allow refrigerant to drain from the (currently unused) coils 26,28 that are connected to the second portion 20*a* of the inlet header 20 and into the cooler 14 and then from the cooler 14 to the compressor 12. This allows recovery of refrigerant left inside the coils 24,26 when the second portion 20*a* is closed off and thus (temporarily) not in use as part of the cooling circuit of the chiller 10. This may allow for more refrigerant flowing in the active parts of the chiller circuit which increases the subcooling and thereby increases the cooling capacity. This can also help to ensure the compressor 12 receives sufficient refrigerant for its proper operation.

Figure 4:
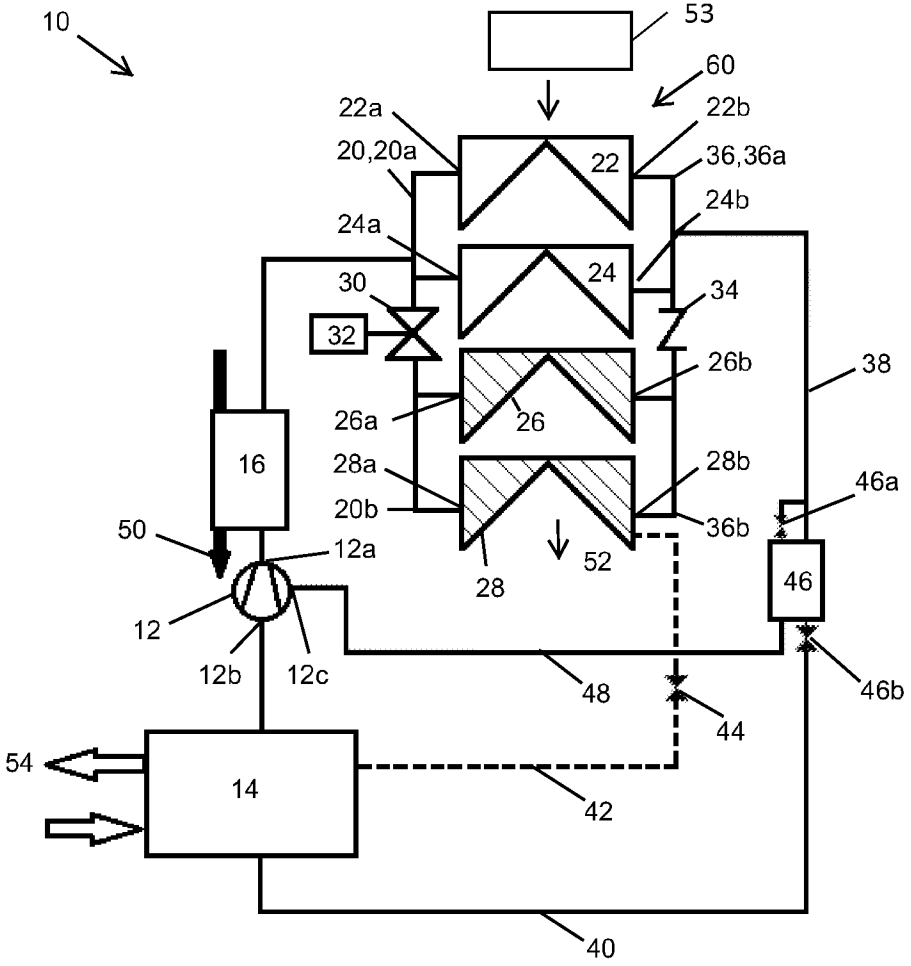
FIG. 4 shows the present air-cooled chiller, in which fluid flow is prevented through two of the coils.

FIG. 4 shows the air-cooled chiller 10 of FIG. 3 in the state where the solenoid valve 30 is closed. The solenoid valve 30 prevents refrigerant from flowing to the second portion 20*a* of the inlet header. This means that all refrigerant flowing into the inlet header 20 flows through only those coils 22,24 connected to the first portion 20*a* of the inlet header 20. The second valve 34 ensures that fluid flowing out of these coils 22,24 does not flow past the outlets 26*b*,28*b* of the coils 26,28 that are connected to the second portion 36*b* of the outlet header 36.

The controller 32 is configured to control the solenoid valve 30. In examples where the second valve 34 is a controllable valve, such as a solenoid valve, the controller 32 may also control the second valve 34. Alternatively, a separate controller may be used. The controller 32 may control the valve 30 based on a desired performance of the air-cooled chiller 10. In general, controlling the solenoid valve 30 to reduce the number of coils 22,24,26,28 that are exchanging heat by natural air convection with the air flow 52 will allow for the production of a hotter fluid flow 50 from the heat exchanger 16. The controller 32 may also control other valves in the system. For example, the controller 32 may control the valve 44 on the refrigerant recovery line 42 or, in examples having multiple refrigerant recovery lines, the controller may control each of the valves on respective refrigerant recovery lines. The controller 32 may control the controllable expansion valves 46*a*,46*b* as well. The controller 32 may control the fan 53, if present, as well.

The heat recovery heat exchanger 16 may be a brazed plate heat exchanger. The economizer heat exchanger 46 may be a brazed plate heat exchanger.

In FIGS. 3 and 4, there are depicted two coils 22,24 connected to the first portion 20*a* of the inlet header and two coils 26,28 connected to the second portion 20*b*. However, in other examples, there may be only a single coil connected to each of the portions 20*a*,20*b* of the inlet header. There may also be unequal numbers of coils connecting to respective portions 20*a*,20*b* of the inlet header 20.

In FIGS. 3 and 4, only one solenoid valve 30 is shown in the inlet header 20 and only one second valve 34 is shown in the outlet header 36. However, additional solenoid valves may be installed in the inlet header 20 to control fluid flow—see e.g. FIG. 5, discussed in detail below. Each additional solenoid valve that is used requires a corresponding second valve located in a corresponding position in the outlet header 36.

Figure 5:
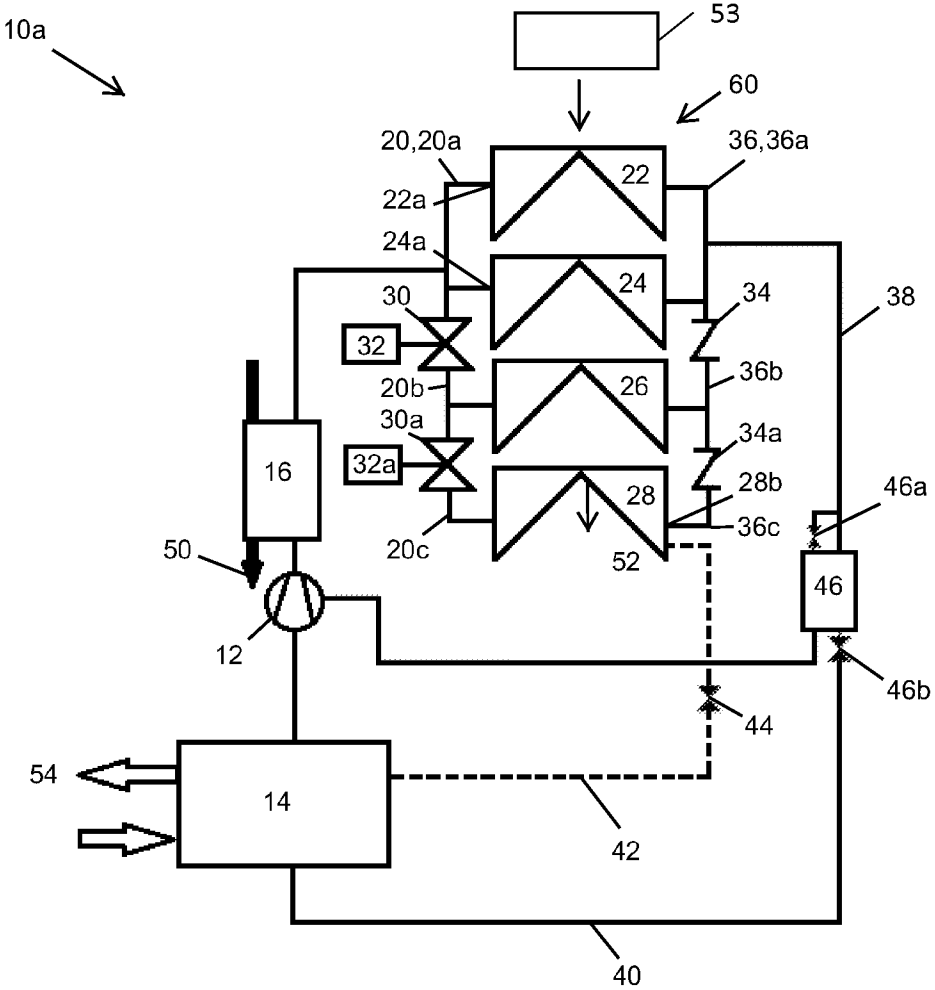
FIG. 5 is another air-cooled chiller according to the present disclosure and having additional an solenoid valve and additional second valve.

FIG. 5 shows an alternative air-cooled chiller 10*a* having two solenoid valves 30,30*a* located in the inlet header 20. This divides the inlet header into three portions 20*a*,20*b*,20*c*. Similarly, there are two second valves 34,34*a* located in corresponding positions in the outlet header, and this divides the outlet header into three portions 36*a*,36*b*,36*c*. As before, the second valves 34,34*a* may be solenoid valves or check valves or a mixture of those.

The first portion 20*a* of the inlet header 20 connects to a first two of the coils 22,24. The second portion 20*b* of the inlet header connects to a third of the coils 26. The third portion 20*c* of the inlet header 20 connects to a fourth of the coils 28. Similarly, the first two of the coils 22,24 connect to the first portion 36*a* of the outlet header 36. The third of the coils 26 connects to the second portion 36*b* of the outlet header 36. The fourth of the coils 28 connects to the third portion 36*c* of the outlet header 36.

In general, the inlet header 20 may be divided, by solenoid valves 30,30*a* etc., into any number of portions, where each portion connects to at least one coil. The outlet header 36 will then be divided into the same number of portions by second valves 34,34*a* etc.

The refrigerant recovery line 42 connects to the last coil or to the last portion of the outlet header 36, i.e. the coil or portion most distant from the first portion 36*a* of the outlet header 36. This means that when at least the last portion is closed off by the associated solenoid valve, refrigerant may be drained from the coil(s) connected to that last portion and delivered to the cooler 14. If further portions are closed off, e.g. portions 20*b*,20*c* and 36*b*,36*c*, then refrigerant may still be drained from these portions and delivered to the cooler 14. In examples where one or more of the second valves 34,34*a* in the outlet header 36 are solenoid valves, this may require that one of the second valves (e.g. the second valve 34*a* between the second 36*b* and third portions 36*c*) is kept open to allow refrigerant to drain from the second portion 36*b* into the third portion 36*c* and then out through the line 42.

Figure 6:
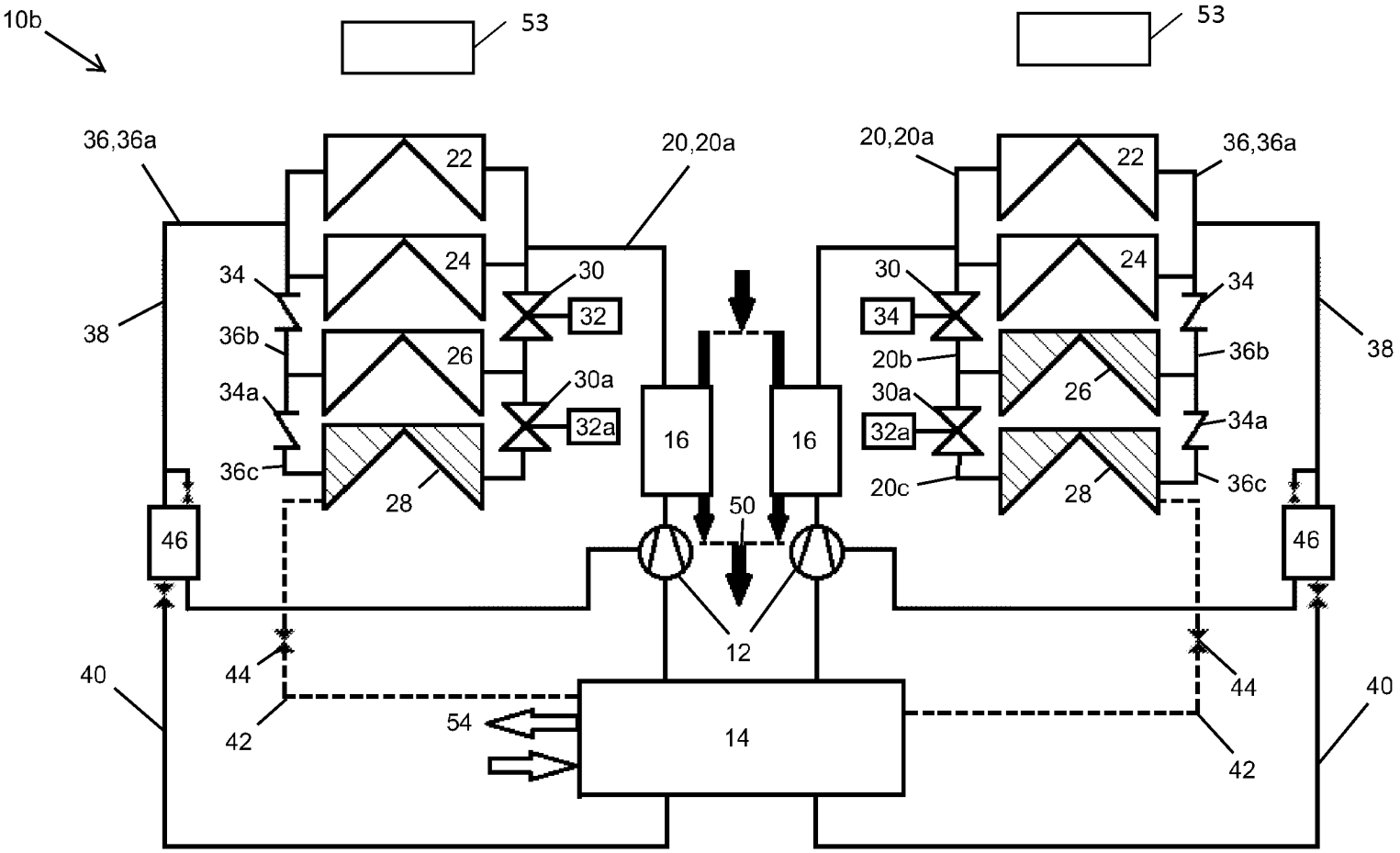
FIG. 6 is another air-cooled chiller according to the present disclosure and having two independently controllable circuits.

FIG. 6 shows an air-cooled chiller 10*b* having a two-circuit design. In this Figure, each circuit is of the same form as the air-cooled chiller 10*a* depicted in FIG. 5, i.e. having multiple solenoid valves 30,30*a* in the respective inlet headers 20. However, the chiller 10 design depicted in FIGS. 3 and 4 may also be used in such a two-circuit design, i.e. chillers having only a single solenoid valve 30 in their inlet header 20.

In FIG. 6, the two circuits are identical, and both circuits' heat exchangers 16 connect to the fluid flow 50 and thereby contribute to the heating of the same fluid flow 50. Both circuits also connect to the chiller 14 and thereby contribute to the cooling of the same fluid flow 54. The solenoid valves 30 in the two circuits may be controlled entirely independently of one another. Thus, in the example shown in FIG. 6, the first two coils (i.e. coils 22,24) are in use in the right-hand circuit, while the first three coils (i.e. coils 22,24,25) are in use in the left-hand circuit. Alternatively they may be controlled together, i.e. synchronously.

Prior art "serial concept" air-cooled chillers 101 having multiple coils (e.g. coils 22,24 in FIG. 1B) may be retrofitted to conform to the design of the presently disclosed arrangement for an air-cooled chiller 10, to improve their performance. To do this, one or more solenoid valve(s) 30 may be installed in the inlet header 20 that feeds into the plurality of coils 22,24, in order to divide the inlet header 20 into at least a first portion and second portion, in the manner discussed above. A controller 32 can then be connected to the one or more solenoid valves 30. Similarly, one or more second valve(s) 34 would be installed in corresponding positions within the outlet header 36. A refrigerant recovery line 42 may also be added as part of the retrofit, the refrigerant recovery line 42 including a recovery solenoid valve 44 (and optionally a check valve too) for controlling refrigerant flow through the refrigerant recovery line 42. Thus, in another aspect, the present disclosure provides a method of retrofitting an existing air-cooled chiller that has multiple coils connected to an inlet header, to provide improved control and/or performance.

Figure 7:
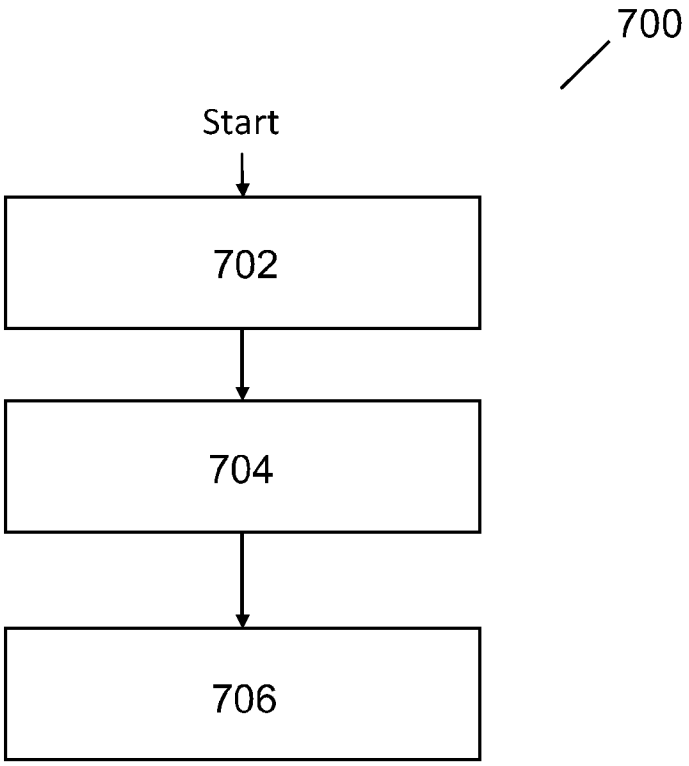
FIG. 7 is a flow-diagram depicting a method of operating the air-cooled chiller according to the present disclosure.

FIG. 7 shows a flow chart of a method 700 of operating the air-cooled chiller 10. The method 700 involves flowing (step 702) refrigerant through the air-cooled chiller 10,10*a*, 10*b* and detecting (step 704) a temperature of the fluid (50) flowing out of the heat recovery heat exchanger (16). When the temperature is below a predetermined threshold (i.e. below a desired temperature), the method involves closing (step 706) the solenoid valve 30 (or at least one of the solenoid valves 30, for those examples having more than one solenoid valve in the inlet header 20) to prevent fluid flow through at least one of the coils.

Closing one or more solenoid valves 30,30*a* etc. reduces the total amount of cooling experienced by the refrigerant flowing through the coils (i.e. the exchange of heat with the air flow 52 is reduced) and thus this allows the average refrigerant temperature throughout the system to increase. As such, there is more heat available to put into the fluid flow 50 and this therefore increases the heating capacity of the air-cooled chiller 10.

Figure 8B:
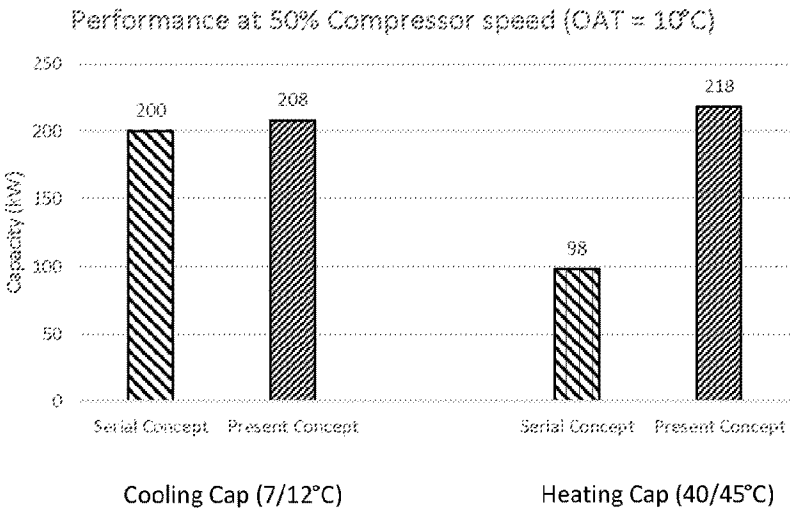
FIGS. 8A and 8B are graphs showing performance improvements offered by the present chiller compared to a prior art chiller.
Figure 8A:
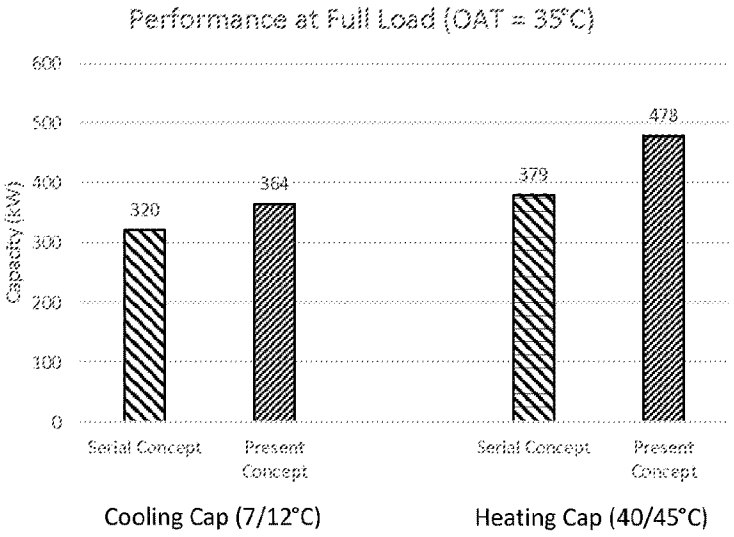

FIGS. 8A and 8B show the performance improvements offered by the present chiller 10 in heat recovery mode. Heat recovery mode is when the flow 50 is flowing past the heat recovery heat exchanger 16. When the flow 50 is not flowing, there is no significant transfer of heat in the heat recovery heat exchanger 16 (i.e. once the fluid of flow 50 has thermalized) and this situation may be referred to as "air cooled mode". Comparison is made between the heat recovery mode of the present air-cooled chiller 10 and the heat recovery mode of a prior art "serial concept" air cooled chiller that is identical to the present air-cooled chiller except that the prior art air cooled chiller lacks both the solenoid valve 30 and the second valve 34 (i.e. meaning that, in the prior art chiller, refrigerant always flows through all of its air-cooled coils). The prior art chiller also lacks the refrigerant recovery line 42 and its recovery solenoid valve 44. In the present air-cooled chiller 100, the solenoid valve 34 is closed. The prior art chiller is therefore referred to as a "serial concept" chiller in these Figures.

The results shown in FIG. 8A are for an outside air temperature (OAT) of 35° C. and the compressor is running at full speed. Under these conditions, the present air-cooled chiller 10 provides a cooling capacity of 364 kW compared to 320 kW for the prior art system. That is, the present system 10 provides a 14% improvement in cooling capacity over the prior art design under these conditions. The present system 10 also provides a heating capacity of 478 kW, compared to 379 kW for the prior art system. That is, the present system provides a 26% improvement in heating capacity over the prior art design under these conditions.

The results shown in FIG. 8B are for an outside air temperature of 10° C. and the compressor is running at 50%. Under these conditions, the present system provides a cooling capacity of 208 kW, compared with 200 kW for the prior art system. That is, the present system 10 provides a 4% improvement in cooling capacity over the prior art design under these conditions. The present system 10 provides a heating capacity of 258 kW, compared to only 98 kW for the prior art design. That is, the present system provides a 122% improvement in heating capacity over the prior art design under these conditions.

When the chiller 10 is running in air cooled mode, performance is improved by using all the coils (e.g. coils 22-28) of the air heat exchanger 60.

The various circuit designs shown in FIGS. 3-6 may be combined together in any combination. That is, in two-circuit designs, the two circuits may be identical or may be different (e.g. in terms of the number of solenoid valves in the inlet header). The two circuits may be controlled in an identical manner or independently, as desired. In examples having multiple solenoid valves 30, the solenoid valves may all be controlled by a single controller or may be controlled by respective controllers 32,32*a* etc.

The or each controller 32,32*a* may comprise a temperature sensor or receive data from a temperature sensor detecting a temperature of the air flow 52. The controller(a) 32,32*a* may be configured to control fluid flow into a respective portion of the inlet header 20 based at least in part on a detected temperature of the airflow 52.

The or each controller 32,32*a* may comprise a temperature sensor or receive data from a temperature sensor detecting an outlet temperature of the fluid flow 50 flowing past the heat recovery heat exchanger(s) 16. The controller(s) 32,32*a* may be configured to control fluid flow into a respective portion of the inlet header 20 based at least in part on a detected outlet temperature of the fluid flow 50. For example, closing one or more portions (e.g. second portion 20*b*) of the inlet header 20 may increase the heating capacity of the air-cooled chiller.

The or each controller 32,32*a* may comprise a (further) temperature sensor or receive data from a (further) temperature sensor detecting an outlet temperature of the fluid flow 54 leaving the cooler 14. The controller(s) 32,32*a* may be configured to control fluid flow into a respective portion of the inlet header 20 based at least in part on a detected outlet temperature of the fluid flow 54 from the cooler 14. For example, opening one or more portions (e.g. second portion 20*b*) of the inlet header 20 may increase the cooling capacity of the air-cooled chiller.

What is claimed is:

1. An air-cooled chiller comprising:

a compressor;

a cooler;

a heat recovery heat exchanger, wherein the heat recovery heat exchanger is connected between an output of the compressor and an input header of an air heat exchanger;

the air heat exchanger comprising:

a first coil and a second coil;

wherein the input header is connected to respective inlets of the first and second coils;

wherein an output header is connected to respective outlets of the first and second coils;

a solenoid valve located in the input header to divide the input header into a first portion and a second portion, wherein the first coil inlet is connected to the first portion and the second coil inlet is connected to the second portion, wherein the solenoid valve selectively controls refrigerant flow into the second portion, such that when the solenoid valve is open, refrigerant is allowed to flow through both the first and second coils in parallel and, when the solenoid valve is closed, refrigerant is prevented from flowing into the second coil;

a controller configured to control the solenoid valve; and a second valve located in the output header to divide the output header into a first portion and a second portion, wherein the first coil outlet is connected to the first portion and the second coil outlet is connected to the second portion, and wherein the second valve is configured to prevent refrigerant flow from the first portion into the second portion of the outlet header;

wherein the first portion of the input header is configured to receive fluid from the compressor output, via the heat recovery heat exchanger; and the first portion of the outlet header is connected to one or more lines for returning fluid to the compressor.

2. The air-cooled chiller according to claim 1, comprising a refrigerant recovery line connecting the output header to the cooler, the refrigerant recovery line having a recovery solenoid valve to selectively allow refrigerant to flow from the output header to the cooler.

3. The air-cooled chiller according to claim 1, wherein the second valve is a check valve or is a solenoid valve.

4. The air-cooled chiller according to claim 1, comprising an economising heat exchanger connected between the output header and the compressor.

5. The air-cooled chiller according to claim 1, wherein a plurality of coils are connected, in parallel with one another, between the first portion of the inlet header and the first portion of the outlet header; and/or wherein a plurality of coils are connected, in parallel with one another, between the second portion of the inlet header and the second portion of the outlet header.

6. The air-cooled chiller according to claim 1, wherein the cooler is arranged to exchange heat with a fluid flow flowing through the cooler, to cool the fluid flow.

7. The air-cooled chiller according to claim 1, wherein the heat recovery heat exchanger is arranged to exchange heat with a fluid flow flowing past the heat recovery heat exchanger, to heat the fluid flow.

8. The air-cooled chiller of claim 7, wherein the controller comprises or is connected to a temperature sensor configured to sense an temperature of the fluid flow at an outlet of the heat recovery heat exchanger; wherein the controller is configured to close the solenoid valve in the inlet header when the temperature of the fluid flow is below a predetermined threshold.

9. The air-cooled chiller according to claim 1, comprising:

a third coil;

a second solenoid valve in the inlet header, such that the inlet header is divided by the solenoid valves into first, second and third portions; and a second second valve in the outlet header such that the outlet header is divided by the two second valves into first, second and third portions;

wherein the third coil is connected between the third portion of the inlet header and the third portion of the outlet header.

10. A two-circuit air-cooled chiller comprising a first circuit and a second circuit, each comprising an air-cooled chiller according to claim 1; and wherein the two-circuit air-cooled chiller is configured such that the or each solenoid valve in the inlet header of the first circuit is controllable independently of the or each solenoid valve in the inlet header of the second circuit.

11. A method of operating the air-cooled chiller according to claim 1, the method comprising:

flowing a refrigerant through the air heat exchanger;

detecting a fluid temperature of a fluid flow flowing out of the heat recovery heat exchanger; and when the temperature of the fluid flowing out of the heat recovery heat exchanger is below a predetermined threshold, using the controller to close at least one solenoid valve in the inlet header to prevent refrigerant flow through at least one of the coils.

12. The method according to claim 11, comprising the step of, when at least one solenoid valve is closed, flowing refrigerant from at least one coil through which refrigerant flow is prevented, to the cooler.

13. A method of retrofitting a serial concept air-cooled chiller to provide the air cooled chiller according to claim 1, wherein the serial concept air-cooled chiller comprises an inlet header, an outlet header, and at least first and second coils connected between the inlet header and outlet header, the method comprising:

installing a solenoid valve in the inlet header at a location between an inlet of the first coil and an inlet of the second coil, such that the solenoid valve may selectively control refrigerant flow to the inlet of the second coil;

installing a second valve in the outlet header at a location between an outlet of the first coil and an outlet of the second coil; and connecting a controller to the solenoid valve to control the solenoid valve.

14. The method according to claim 13, further comprising a step of installing a refrigerant recovery line to connect between the outlet of the second coil and the cooler, the refrigerant recovery line having a recovery solenoid valve.

* * * * *